US005118239A

United States Patent [19]

Morioka

[11] Patent Number: 5,118,239

[45] Date of Patent: Jun. 2, 1992

[54] CUBIC PARKING APPARATUS

[75] Inventor: Hiroshi Morioka, Kanazawa, Japan

[73] Assignee: Nissei Build Kogyo Kabushiki Kaisha, Kanazawa, Japan

[21] Appl. No.: 568,056

[22] Filed: Aug. 16, 1990

[30] Foreign Application Priority Data

May 23, 1990 [JP] Japan ..... 2-133177
Jul. 9, 1990 [JP] Japan ..... 2-181713

[51] Int. Cl.[5] ..... E04H 6/14
[52] U.S. Cl. ..... 414/235; 414/239
[58] Field of Search ..... 414/233, 234, 239, 240, 414/253, 255, 256, 259, 260, 264, 277–280, 282, 661, 286, 235; 198/465.2, 345.3

[56] References Cited

U.S. PATENT DOCUMENTS

| | | | |
|---|---|---|---|
| 2,626,065 | 1/1953 | Sanders et al. | 414/256 |
| 2,726,515 | 9/1956 | Ingold | 414/239 |
| 2,857,060 | 10/1958 | Carroll | 414/260 |
| 3,211,302 | 10/1965 | Bianca | 414/253 X |
| 3,240,364 | 3/1966 | Kapnek et al. | 414/240 X |
| 3,337,070 | 8/1967 | Guilbert, Jr. | 414/661 |
| 3,680,718 | 8/1972 | Miyachi | 414/239 |
| 4,201,284 | 5/1980 | Brems | 198/345.3 |
| 4,690,611 | 9/1987 | Nobuhara | 414/259 X |
| 4,787,496 | 11/1988 | Prodel et al. | 198/465.2 X |
| 4,936,730 | 6/1990 | Morioka | 414/239 |
| 5,009,559 | 4/1991 | Tsay | 414/259 |
| 5,018,926 | 5/1991 | Sternad | 414/239 X |

FOREIGN PATENT DOCUMENTS

| | | | |
|---|---|---|---|
| 786661 | 6/1968 | Canada | 414/286 |
| 247524 | 12/1987 | European Pat. Off. | 414/280 |
| 1014788 | 4/1983 | U.S.S.R. | 414/277 |

*Primary Examiner*—David A. Bucci
*Attorney, Agent, or Firm*—Oblon, Spivak, McClelland, Maier & Neustadt

[57] ABSTRACT

The present invention relates to a cubic parking apparatus vertically formed with parking spaces in a multi-stage fashion to move a car in and out of the parking space through a pallet, in which guides and lateral guides are provided on the parking spaces and a carriage of an elevator, and a transfer device for laterally moving the pallet is provided on the carriage whereby when the pallet is delivered between the carriage and the parking space, a great torsional moment is prevented from being loaded in the carriage to simplify a construction of an elevator device. There is provided a cubic parking apparatus in which a turning device is provided which can be moved forward and backward in an approximately horizontal direction with respect to the carriage passing path, whereby a home position for moving the carriage above and below a position at which the turning device is disposed to move a car in and out of the parking space can be disposed on a suitable story, and parking spaces can be effectively secured.

9 Claims, 14 Drawing Sheets

CUBIC PARKING APPARATUS

BACKGROUND OF THE INVENTION

This invention relates to a solid or cubic parking apparatus of the type in which cars are moved into and out of parking spaces formed in a vertical multi-stage fashion using an elevator, in which cars can be moved into and out of the spaces safely and smoothly.

A rack type cubic parking apparatus has been known, which comprises a combination of an elevator provided with a vertically movable carriage and parking spaces disposed in a multi-stage fashion along the passage on which the carriage vertically moves. For example, the present applicant has U.S. Pat. No. 4,936,730 as prior art, in which movement of a car into and out of a parking space is effected through a pallet so that the pallet with a car loaded thereon is transferred between a carriage for receiving a pallet to vertically move the same and a parking space provided with a shelf member for supporting the pallet. For the aforesaid transferring operation, there is employed a construction in which such operation is effected through an expansible fork device loaded on the carriage. That is, the fork device can extend horizontally toward the parking space in the state where the pallet is loaded thereon. After the fork device has extended directly above the shelf member, the carriage is moved down to transfer the pallet onto the shelf member whereby the pallet is transferred from the carriage to the parking space. When the pallet is transferred from the parking space to the carriage, the fork device is extended under the pallet, and the carriage is then moved up whereby the pallet is supported on the fork device, and thereafter the fork device is contracted to transfer the pallet onto the carriage.

However, according to such an apparatus as described above, when the pallet is transferred, the fork device extended from the carriage to the parking space bears the whole weight of the pallet being transferred and a car to load a large torsional moment to the carriage. Accordingly, this leads to a problem in that the whole apparatus need be formed in a large scale in order to support them in a stable manner. There further involved an inconvenience in that a dead space for the fork device was necessary below the pallet within the parking space, and therefore, effective utilization factor of a building height is low, and when the height of a building is restrained to a certain level, a large space for receiving lots of cars cannot be obtained.

On the other hand, in the cubic parking apparatus as described above, a plane-area home position is constituted by a space for an elevator and parking spaces on opposite sides thereof, and a pit is provided immediately below the home position whereby direction-turn of a car moved in and out is carried out by a turning device disposed in the pit. This provides advantages such that required floor areas in respective floors including the home position can be made the same, and since the car need not be moved back during the movement of the car into and out of the space, the operation for in and out movements becomes extremely easy, and the whole parking structure can be formed into a simple tower-like construction.

However, there is a further problem in that the aforementioned turning device has to be disposed on the lowest floor of the parking structure and cannot be provided on other floors. That is, the turning device has to be disposed at a central position of the home position.

The turning device obstructs the vertical movement of the carriage, and the home position cannot be provided in the mid-floor. In order to solve this problem, it is contemplated that the turning device is loaded on the carriage so that the former is moved up and down along with the carriage. However, in the case where the heavy turning device is always moved up and down along with the carriage, an output required for an elevator driving device, a strength required for peripheral members supporting the carriage and the like excessively increase, being uneconomical.

OBJECTS OF THE INVENTION

A first object of the present invention is to reduce a torsional moment produced when a pallet is transferred in the aforementioned carriage, simplify the whole construction of an elevator device and effectively utilize a building for parking without forming a wasteful parking space into which a fork device is received.

A further object of the invention is to provide a turning device for changing the direction of a car on a suitable floor so as to secure parking spaces in the vertical direction of the home position. More specifically, the vertically moving carriage and the turning device are not interferred with each other if not necessary.

BRIEF DESCRIPTION OF THE DRAWINGS

FIGS. 1 to 9 show an embodiment of a carriage according to the present invention.

FIG. 1 is an exploded perspective view of essential parts;

FIG. 2 is a sectional view taken on line II—II of FIG. 1;

FIG. 3 is an explanatory view showing the whole cubic parking apparatus;

FIGS. 4, 5A, and 5B show essential parts of FIG. 1;

FIGS. 6 and 7 are plan views showing essential parts of FIG. 1;

FIG. 12 is a side sectional view of essential parts;

FIG. 13 is a sectional view taken on line XIII—XIII of FIG. 12;

FIGS. 14 and 15 are explanatory views of essential parts shown in FIG. 12;

FIG. 16 is a sectional view taken on line XVI—XVI of FIG. 12;

FIG. 17 is partially sectional view showing the state where the carriage is positioned at the same level;

FIGS. 18 to 20 are views for operation of the turning device shown in FIG. 1;

and FIG. 21 is a sectional view showing a further example of arrangement of the turning device according to the present invention.

DETAILED DESCRIPTION OF THE INVENTION

Figure 3:
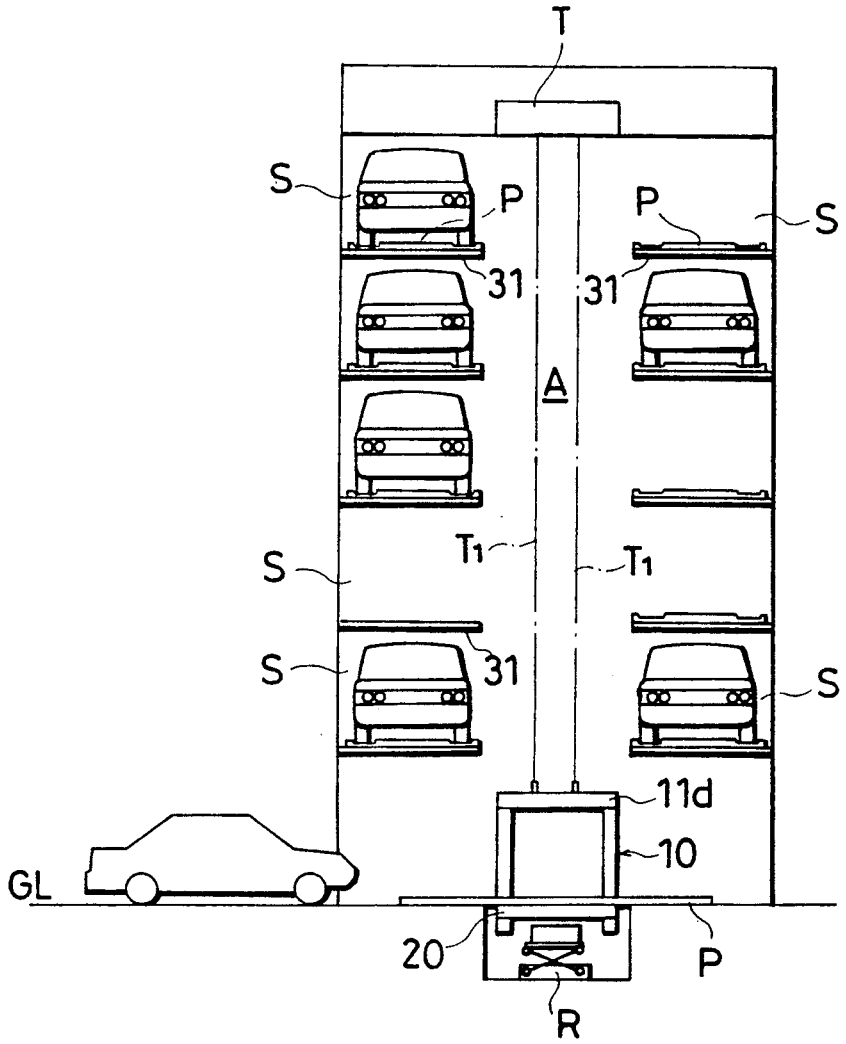

The cubic or solid parking apparatus comprises, as shown in FIG. 3, a carriage 10 and parking spaces S, S . . . disposed in a multi-stage fashion along a vertical elevator passage A of the carriage 10.

The carriage according to the present invention will be first described in connection with an embodiment with reference to FIGS. 1 to 11.

Figure 1:
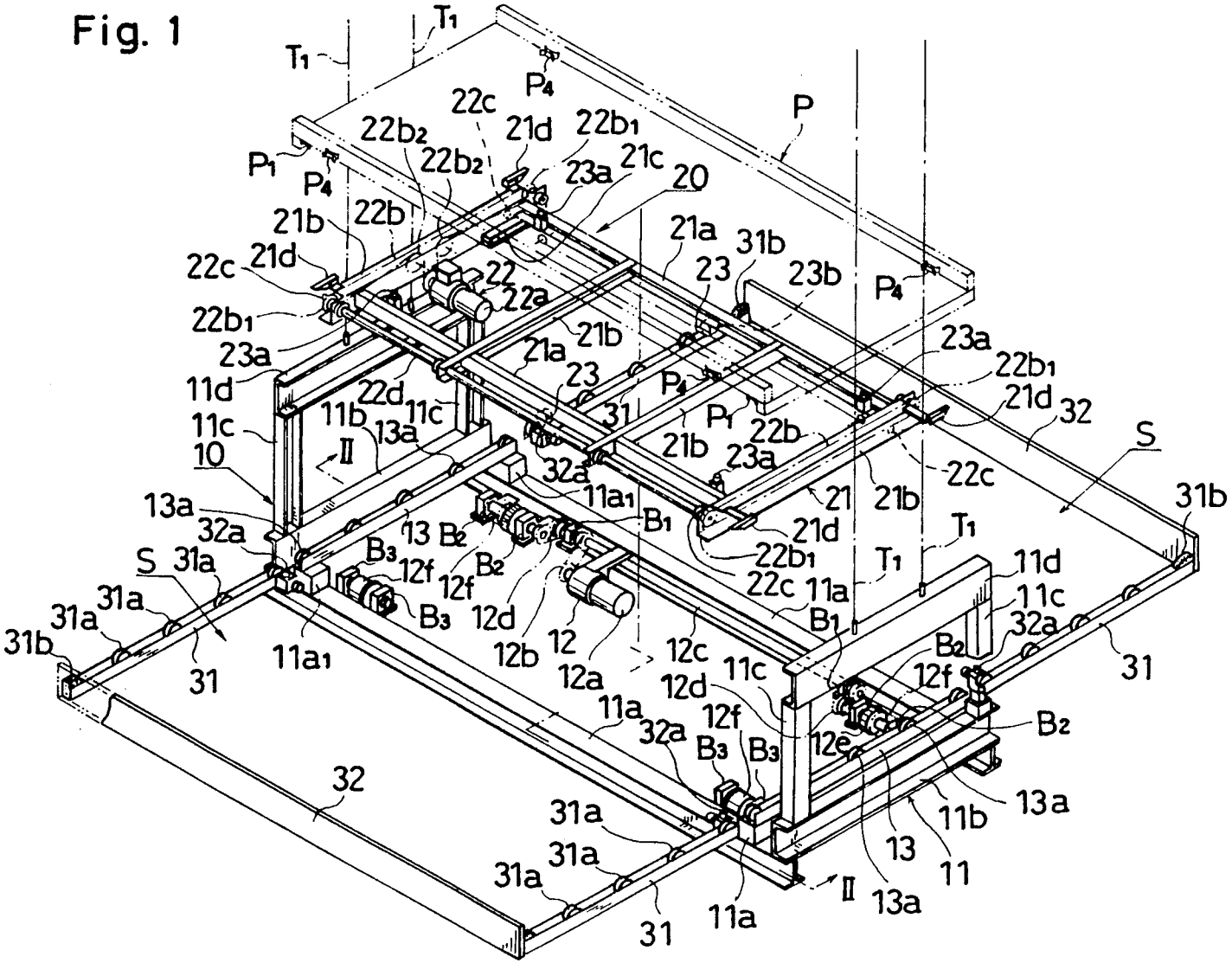

The carriage 10 is designed so that a slide frame 20 is laterally movably loaded on a carriage body 11 formed from section steel assembled into a frame-like configuration as shown in FIG. 1, and a drive device 12 for driving the slide frame 20 is incorporated into the carriage body 11.

The carriage body 11 comprises a pair of frames 11*a*, 11*a*, frames 11*b*, 11*b* before and behind thereof, each pair of frames 11*c*, 11*c* . . . stood upright on the frames 11*b*, 11*b*, and frames 11*d*, 11*d* to which are connected upper ends of the frames 11*c*, 11*c*.

The drive device 12 for driving the slide frame 20 is disposed along the inner side of one frame 11*a*. The drive device 12 comprises a motor 12*a* secured to the frame 11*a*, a drive shaft 12*c* connected to the motor 12*a* through a chain 12*b*, and pinions 12*e*, 12*e* connected to the drive shaft 12*c* through chains 12*d*, 12*d* on opposite ends of the drive shaft 12*c*. The drive shaft 12*c* and the pinions 12*e*, 12*e* are rotatably supported by bearings $B_1$, $B_2$, $B_3$ . . . secured to the respective frames 11*a*. Each pair of rollers with collar 12*f*, 12*f* . . . are rotatably mounted internally of the frames 11*a*, 11*a* through bearings $B_2$, $B_2$ or $B_3$, $B_3$. The rollers 12*f* and 12*f* on the side of the pinions 12*e* and 12*e* are rotatably mounted coaxial with the pinions 12*e* (See FIGS. 1 and 2).

On each inner side of the front and rear frames 11*b*, 11*b* are mounted a pair of laterally moving guides 13, 13 through pedestals $11a_1$, $11a_1$ . . . fixed on the frames 11*a*, 11*a*. Each laterally moving guide 13 is formed from a channel-like member opened upwardly, and rollers 13*a*, 13*a* . . . outer peripheral portion of which are projected upwardly are rotatably mounted thereon.

The carriage 10 is vertically movably suspended by an elevator device T disposed upwardly of the passage A through roller chains $T_1$, $T_1$ . . . connected to the frames 11*d*, 11*d* as shown in FIG. 3. Disposed on the carriage 10 are guide rollers and vertically moving guides along guide posts of the vertical passage A not shown, and both of these elements are engaged so as to prevent the carriage 10 from occurrence of unnecessary horizontal movement.

The slide frame 20 is loaded on the carriage 10 and comprises, as shown in FIG. 1, a body 21, a transfer device 22, and positioning mechanisms 23, 23. The body 21 comprises left and right frames 21*a*, 21*a*, and frames 21*b*, 21*b* . . . for connecting the frames 21*a*, 21*a* in a ladder-like fashion.

Figure 2:
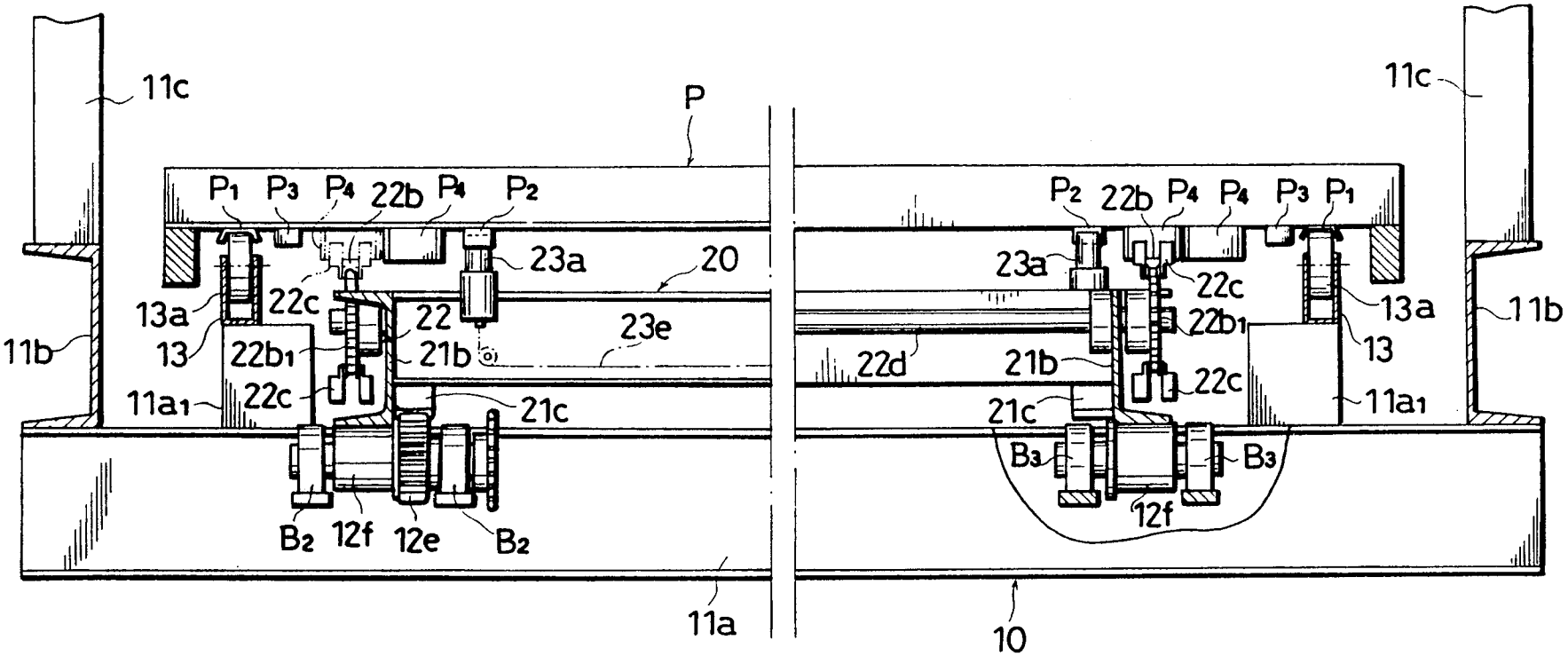

The transfer device 22 comprises a motor 22*a* secured to the front frame 21*b* of the body 21, roller chains 22*b*, 22*b* disposed along the front and rear frames 21*b*, 21*b*, and a connecting shaft 22*d* for interlocking the roller chains 22*b*, 22*b* (see FIGS. 1 and 2). The front roller chain 22*b* is endlessly passed over an output shaft of the motor 22*a* through left and right guide sprockets $22b_1$, $22b_1$, and central tension sprockets $22b_2$, $22b_2$, as shown in FIG. 1, whereas the rear roller chain 22*b* is passed over the left and right guide sprockets $22b_1$, $22b_1$. Each of the left guide sprockets $22b_1$, $22b_1$ is secured to opposite ends of a connecting shaft 22*d*, and a pair of engaging members 22*c*, 22*c* are mounted outwardly on each roller chain 22*b*.

Figure 4:
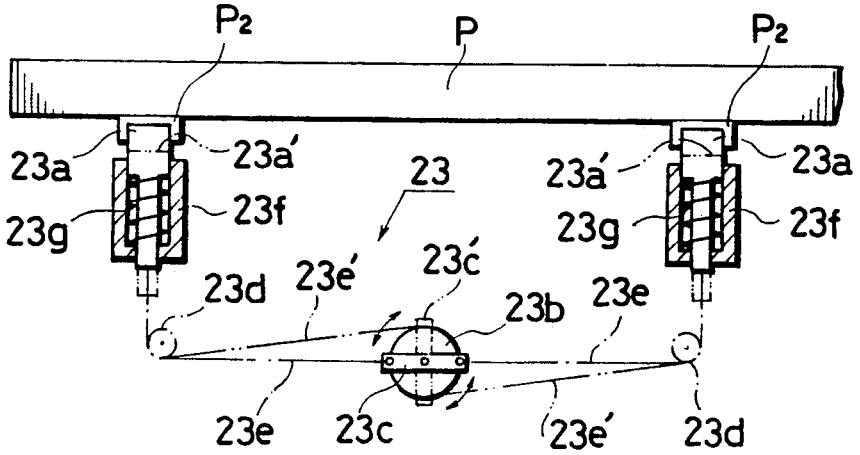
Figure 6:
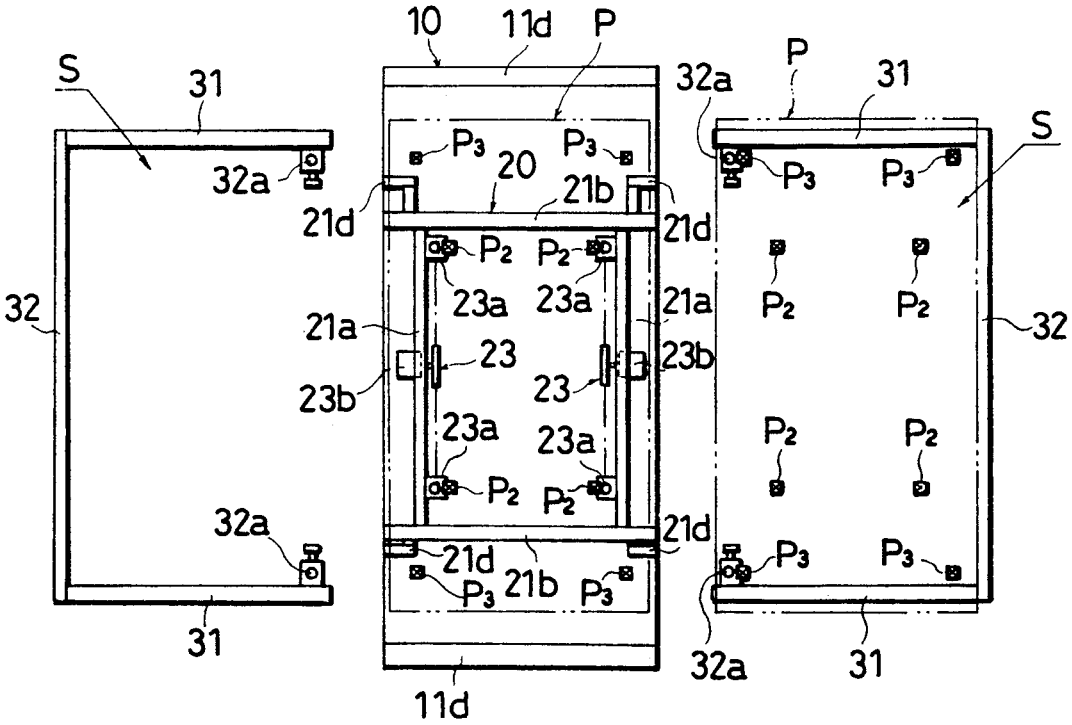

The positioning mechanisms 23, 23 are respectively disposed at positions along the pair of left and right frames 21*a*, 21*a* as shown in FIG. 6. Each positioning mechanism 23 comprises positioning members 23*a*, 23*a* mounted internally of the opposite ends of the frame 21*a*, a motor 23*b*, an arm 23*c* connected to the motor 23*b*, and wires 23*e*, 23*e* for connecting the positioning members 23*a*, 23*a* with opposite ends of the arm 23*c* through rollers 23*d*, 23*d*. The positioning members 23*a*, 23*a* are slidably inserted into holders 23*f*, 23*f* as shown in FIG. 4 and upwardly urged by compression springs 23*g*, 23*g*. On the other hand, the arm 23*c* is changed to a horizontal position and a vertical position (indicated by the solid line and the dash-dotted contour lines in FIG. 4) by the motor 23*b*, and the positioning members 23*a*, 23*a* may be moved up and down accordingly to an engaging position and a withdrawn position (indicated at 23*a*').

The slide frame 20 is loaded laterally movably with respect to the carriage 10 through the pinions 12*e*, 12*e* disposed on the carriage 10 and the rollers 12*f*, 12*f* . . . (FIGS. 1 and 3). More specifically, the front and rear frames 21*b*, 21*b* of the body 21 are placed on the rollers 12*f*, 12*f* of the carriage 10, and on the lower surface of the body 21 are provided racks 21*c*, 21*c* parallel to the front and rear frames 21*b*, 21*b* and engaged with the pinions 12*e*, 12*e* from the top. Release members 21*d*, 21*d* . . . projecting in a direction of the side of the body 21 are secured to the front and rear frames 21*b*, 21*b* of the body 21 so that wedge-like ends thereof are directed outwardly (FIG. 1).

In each parking space S, a pair of guides 31 are provided in correspondence to the lateral guides 13, 13 of the carriage 10 as shown in FIG. 1. The guide 31 is similar in construction to the lateral guide 13, and rollers 31*a*, 31*a* . . . are rotatably provided in an opening of a channel-like member. On the deep end of the guides 31, 31 are mounted damping members 31*b*, 31*b*, and a stopper board 32 is mounted so as to connect the former.

Figure 5A:
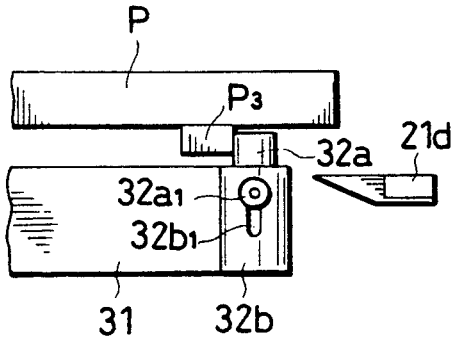
Figure 5B:
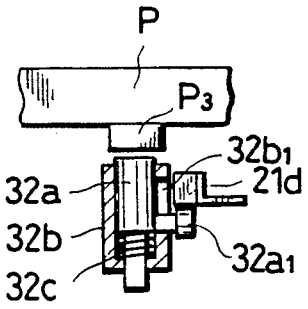

A positioning member 32*a* shown in FIG. 5 is arranged at the end of each guide 31. The positioning member 32*a* is slidably inserted through a compression spring 32*c* into a holder 32*b* having a slot $32b_1$, and a cam follower $32a_1$ projected from the slot $32b_1$ is provided integral with the positioning member 32*a*. Each positioning member 32*a* is provided so as to face to the release member 21*d* of the slide frame 20 so that the release member 21*d* moves forward to press down the cam follower $32a_1$ so as to move the positioning member 32*a* downwardly.

Pallets P, P . . . used in the cubic parking apparatus as described above are provided in the same number as that of the parking spaces S, S . . . , and are formed into a plate-like configuration, on the upper surface of which is placed a car.

The pallet P is provided in its lower surface with a pair of guide members $P_1$, $P_1$, projections $P_2$, $P_2$ . . . , $P_3$, $P_3$, and engaging members $P_4$, $P_4$ . . . (see FIGS. 2, 6 and 7).

The guide members $P_1$, $P_1$ are formed from a channel-like member downwardly opened as shown in FIG. 2, and correspond to the carriage 10 and the lateral guides 13, 13 and guides 31, 31 of the parking space S at front, rear and both ends of the pallet P. That is, the pallet P is placed on the slide frame 20 so that the guide members $P_1$, $P_1$ correspond to the lateral guides 13, 13. At that time, the projections $P_2$, $P_2$ . . . are defined from the outside by the positioning members 23*a*, 23*a* . . . of the slide frame 20 as shown in FIG. 6. Further, when the pallet P is received onto the guides 31, 31 within the parking space S, either pair of of the left and right projections $P_3$ are defined by the positioning members 32*a*, 32*a*.

Figure 7:
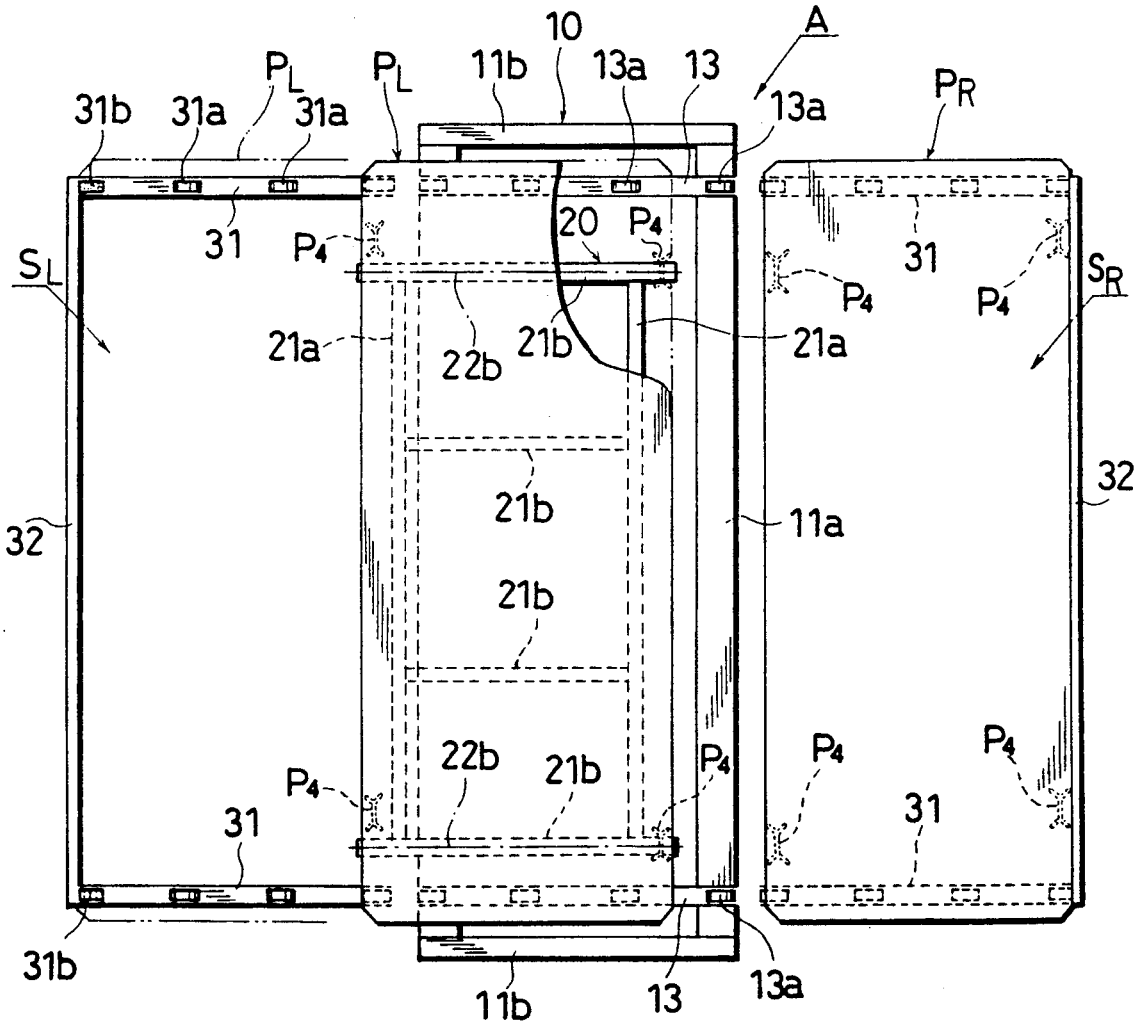

The engaging members $P_4$, $P_4$ . . . are engaged with engaging members 22*c*, 22*c* . . . of the transfer device 22 as shown in FIG. 2. Preferably, two kinds of the engaging members $P_4$, $P_4$ . . . are prepared which are different in linear symmetry with respect to a right pallet $P_R$ received in the right parking space $S_R$ and a left pallet $P_L$ received by the left parking space $S_L$, as shown in FIG. 7. Only one pair of the members $P_4$ on each side of the vertical passage. A corresponds to the roller chains 22*b*, 22*b* of the transfer device 22 arranged eccentrically in the lateral direction with respect to the carriage 10. That is, in any pallets P, P, only the engaging members $P_4$, $P_4$ on the side of the vertical passage A correspond to the roller chains 22*b*, 22*b*, and the whole construction of each pallet P including the engaging members $P_4$, $P_4$ . . . is formed to be a point symmetry with respect to the center of mechanical dimension thereof. With this, when the pallets P, P are rotated horizontally through 180° and arranged in the carriage 10 and parking spaces S, S . . . , the relative positional relation of each member is exactly the same as that before rotation.

Operation when a car is received into a parking space S will be described. It is noted in the beginning of the description that the pallet P corresponding to the parking space S is set a ground floor GL through the carriage 10.

First, the car itself moves onto the pallet P on the ground floor GL. Subsequently, the turning device R is utilized to let the car pass through the center between the carriage 10 and the slide frame 20 to push up the pallet P from the bottom to float it from the ground floor GL. Then, the pallet P is rotated horizontally through 90°, and thereafter the turning device R is moved down whereby the guide member $P_1$ of the pallet P is placed on the lateral guides 13, 13 of the carriage 10. Then, the positioning members 23*a*, 23*a* . . . of the slide frame 20 are projected to their engaging position into engagement with the projections $P_2$, $P_2$ . . . to thereby lock the pallet P to the carriage 10.

Figure 8A:
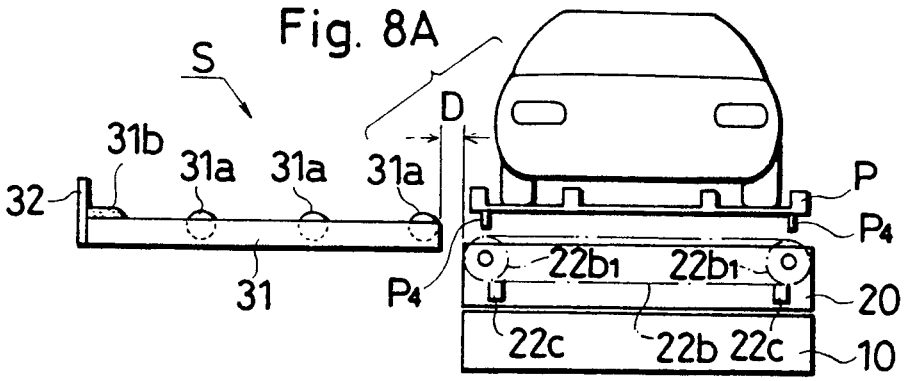
FIGS. 8(A) to (D) and FIGS. 9(A) to 9(D) are views for explaining the operation of the carriage shown in FIG. 1.

The elevator device T is driven to move the carriage 10 upward to face to the guides 31, 31 of the predetermined parking space S, and the lateral guides 13, 13 of the carriage 10 cause the carriage 10 lo stop at the same level height (as shown in FIG. 8(A) with the lateral guides 13, 13 omitted). A gap D is formed between the carriage 10 and the lateral guides 31, 31 to allow the carriage 10 to move up and down.

Figure 8B:
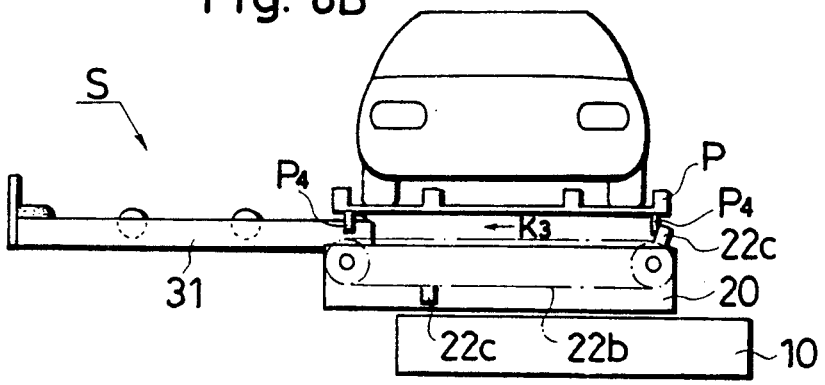
Figure 8C:
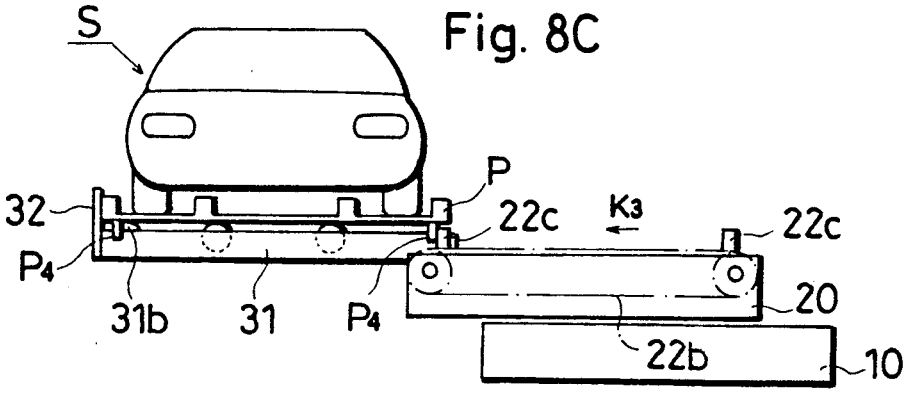

The drive device 12 for the carriage 10 is driven to laterally move the slide frame 20 through the pinions 12*e*, 12*e* and racks 21*c*, 21*c* so that a part thereof is moved into the parking space S (FIG. 8(B)). Since at this time, the positioning members 23*a*, 23*a* . . . of the slide frame 20 are in engagement with the projections $P_2$, $P_2$ of the pallet P, the pallet P laterally moves integral with the slide frame 20. When the slide frame 20 laterally moves, the pair of release members 21*d*, 21*d* disposed on the slide frame 20 cause the positioning members 32*a*, 32*a* of the guides 31, 31 to be pressed down as shown in FIG. 5 (B), and therefore the pallet P can be moved forward without trouble.

Among the positioning members 23*a*, 23*a* . . . , only one pair of positioning members on the side f the parking space S which receives a car are driven to the withdrawing position, and the transfer device 22 is driven upon release of the engagement with the projections $P_2$, $P_2$. Then the roller chains 22*b*, 22*b* rotate to travel the engaging members 22*c*, 22*c* . . . in a direction as indicated by arrow $K_3$. Since the roller chains 22*b*, 22*b* correspond to the pair of engaging members $P_4$, $P_4$ of the pallet P, the engaging members 22*c*, 22*c* can be engaged with the engaging members $P_4$, $P_4$. When the engaging members 22*c*, 22*c* are travelled, the pallet P can be moved onto the guides 31, 31 of the parking space S to transfer the pallet P to the parking space S (FIG. 8(C). The forward limit of the pallet P is defined by the damping members 31*b*, 31*b* and stopper board 32.

Figure 8D:
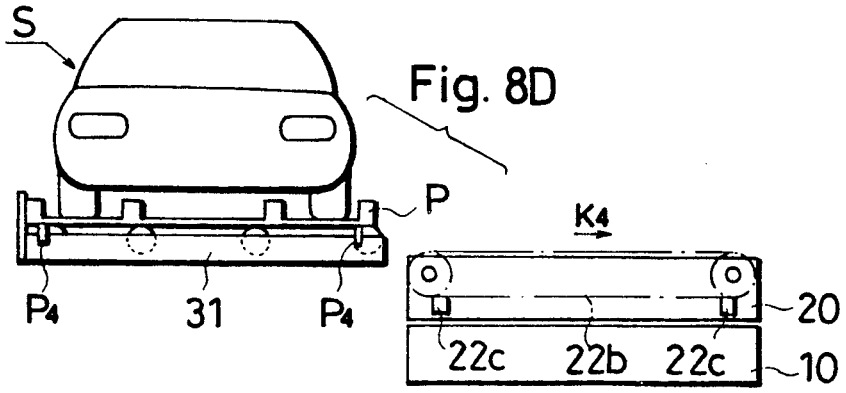
Figure 9A:
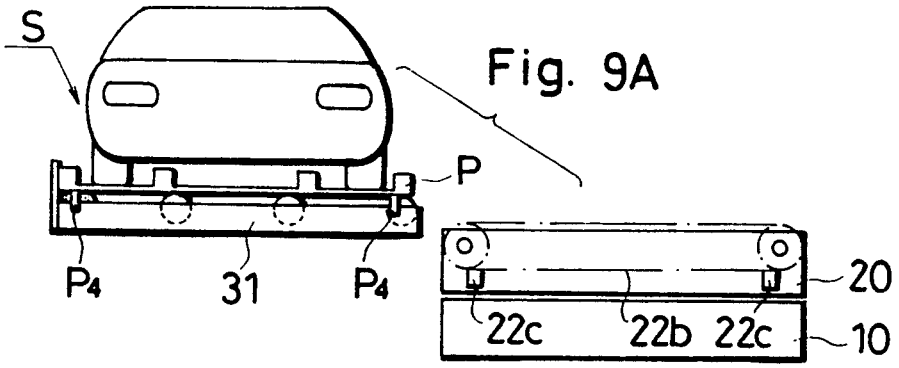
Figure 9B:
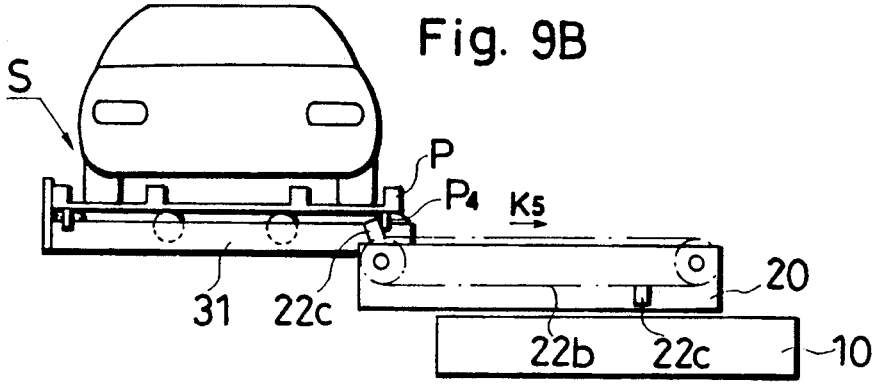
Figure 9C:
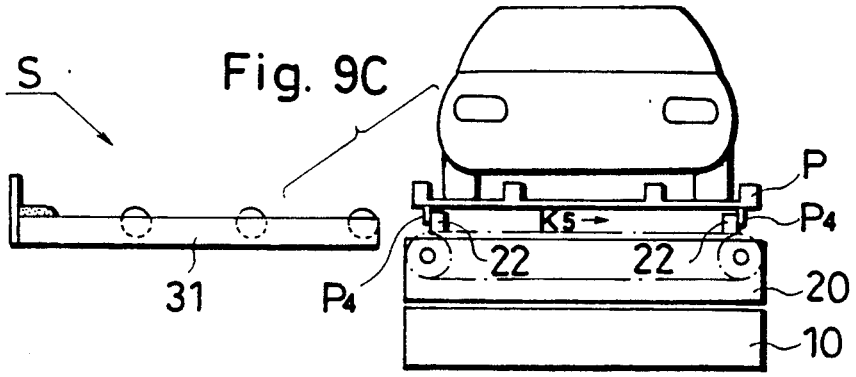
Figure 9D:
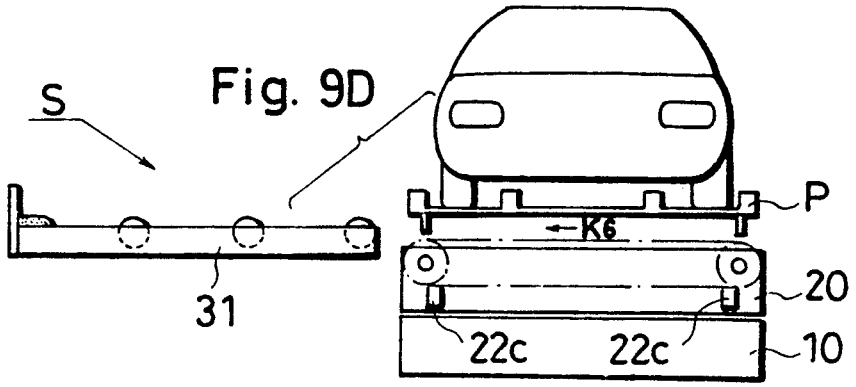

Thereafter, the slide frame 20 is returned to a position directly above the carriage 10 (FIG. 8(D)), and the engaging members 22*c*, 22*c* are travelled in a direction of arrow $K_4$ to return them to their original position. The positioning members 32*a*, 32*a* is released from engagement with the release members 21*d*, 21*d* as shown in FIG. 5(A) upon retreat of the slide frame 20, as a consequence of which the positioning members move upward to engage the projections $P_3$, $P_3$ with respect to the pallet P on the lateral guides 31, 31. Thereby, the pallet P can be held stabilized within the parking space S.

A series of operations for transferring the pallet P on the carriage 10 to the parking space S can be extremely smoothly carried out because the lateral guides 13, 13 for supporting the pallet P and the guides 31, 31 are linearly arranged, and the rollers 13*a*, 13*a* . . . , 31*a*, 31*a* . . . are mounted on both the members. In addition, the whole weight of the pallet P being transferred and the car is always supported from the bottom by the lateral guides 13, 13 and the guides 31, 31, and there possibly exerts no unnecessary torsional moment on the carriage 10.

The transfer of the pallet P from the parking space S onto the carriage 10 may be done by the procedure reversed to the previous operation. That is, first, the slide frame 20 is laterally moved (FIG. 9 (A) and (B)), and the positioning members 32*a*, 32*a* are moved down to release locking of the pallet P. The transfer device 22 is driven to the engaging members 22*c*, 22*c* in a direction of arrow $K_5$ and the pallet P on the guides 31, 31 is moved onto the lateral guides 13, 13 (FIGS. 9 (C) and (D)). The engaging member $P_4$ of the pallet P is locked by the positioning members 23*a*, 23*a* . . . , and the slide frame 20 is returned toward the center of the carriage. The engaging members 22*c*, 22*c* are further travelled in a direction of arrow $K_6$ to be returned, then the transfer operation is completed. One pair of positioning members 23*a*, 23*a* . . . on the side opposite to the parking space S out of which a car moves are driven in advance to the engaging position prior to moving the pallet P in order to prevent the pallet P from being excessively moved, whereas the pair of positioning members on the side of the parking space S are drived to the engaging position after movement of the pallet P to complete locking the pallet P.

Another embodiment of carriage 10

Figure 10:
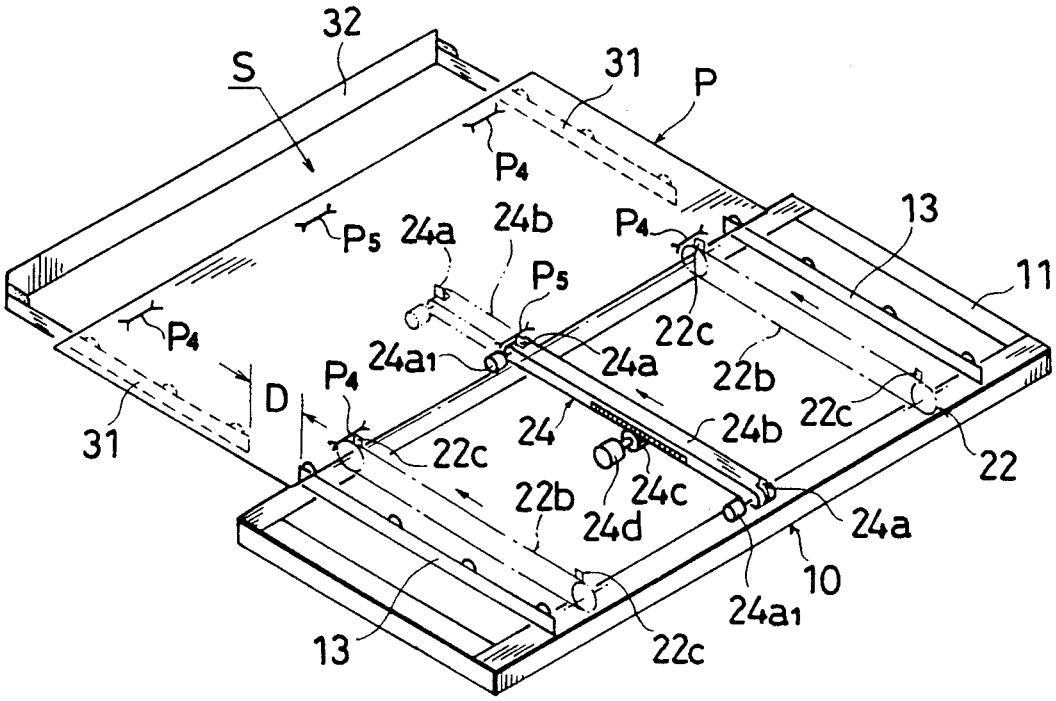
FIG. 10 is a perspective view showing a further embodiment of a carriage according to the invention.

Auxiliary transfer device 24 can be used in place of the slide frame 20 as shown in FIG. 10. The transfer device 22 is loaded directly on the body of :he carriage 10, and the auxiliary transfer device 24 is loaded in the intermediary portion thereof.

Figure 11:
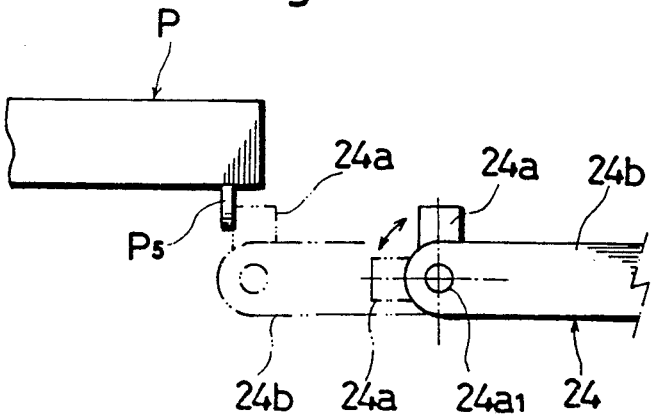
FIG. 11 is an enlarged view of essential parts shown in FIG. 10.

The auxiliary transfer device 24 comprises a rack 24*b* having rise- and fallable hook members 24*a*, 24*a* on opposite ends thereof and a motor 24*d* with a pinion 24*c* for driving the rack 24b, the hook members 24a, 24a being rotatively driven through a drive mechanism 24a$_1$ such as a rotary solenoid as shown in FIG. 11. for example, to assume an upright attitude and a horizontal attitude. The rack 24b can be protruded through a portion corresponding to at least gap D in a lateral direction of the carriage 10 by normally or reversely driving the motor 24d (indicated by dash-dotted contour lines in FIG. 10). Further projections $P_5$, $P_5$ in engagement with the hook members 24a, 24a are disposed on the lower surface of the pallet P.

In transferring the pallet P on the carriage 10 into the parking space S, the transfer device 22 is first driven to bring the engaging members 22c, 22c into engagement with the projections $P_4$, $P_4$ of the pallet P to laterally move the pallet P. At that time, even If the engaging members 22c, 22c arrive at their forward limit, the pallet P is short in moving stroke through a portion corresponding to the gap D, and thereafter, the hook member 24a is stood upright to engage the projection $P_5$ whereby the rack 24b is laterally moved to completely move the pallet P to a predetermined position (indicated by dash-dotted contour lines in FIG. 11).

When the pallet P within the parking space S is transferred onto the carriage 10, the hook 24a is first fallen to its horizontal attitude, in which state the rack 24b is protruded toward the parking space S till the hook 24a goes beyond the position of the projection $P_5$. Thereafter, when the hook 24a is stood upright to retreat the rack 24b, the pallet P can be drawn toward the carriage 10. Thereafter, the pallet P can be moved horizontally by the transfer device 22 to a predetermined position on the carriage 10. At this time, the auxiliary transfer device 24 is necessary to be inserted into a space below the pallet P received into the parking space S, and therefore, the height dimension thereof is preferably made to be lower than the guides 31, 31 to minimize an unnecessory dead space.

As described above, according to this invention, the carriage and the parking space are Provided with the lateral guides and the guides whereby the whole weight of the pallet being transferred and the car can be supported by the lateral guides and/or the guides and the unnecessary torsional moment exerting on the carriage can be effectively eliminated. Accordingly, even if the construction of the carriage is simplified, high operating reliability of the carriage can be realized. Furthermore, it is not neccessary to provide a dead space for inserting the fork device below the pallet within the parking space. Therefore, there is an extremely excellent effect in that the effective utilization factor of the building height can be improved to increase the number of cars to be received.

The structure of the home position according to the present invention will be described in detail with reference to FIGS. 12 to 20.

Figure 12:
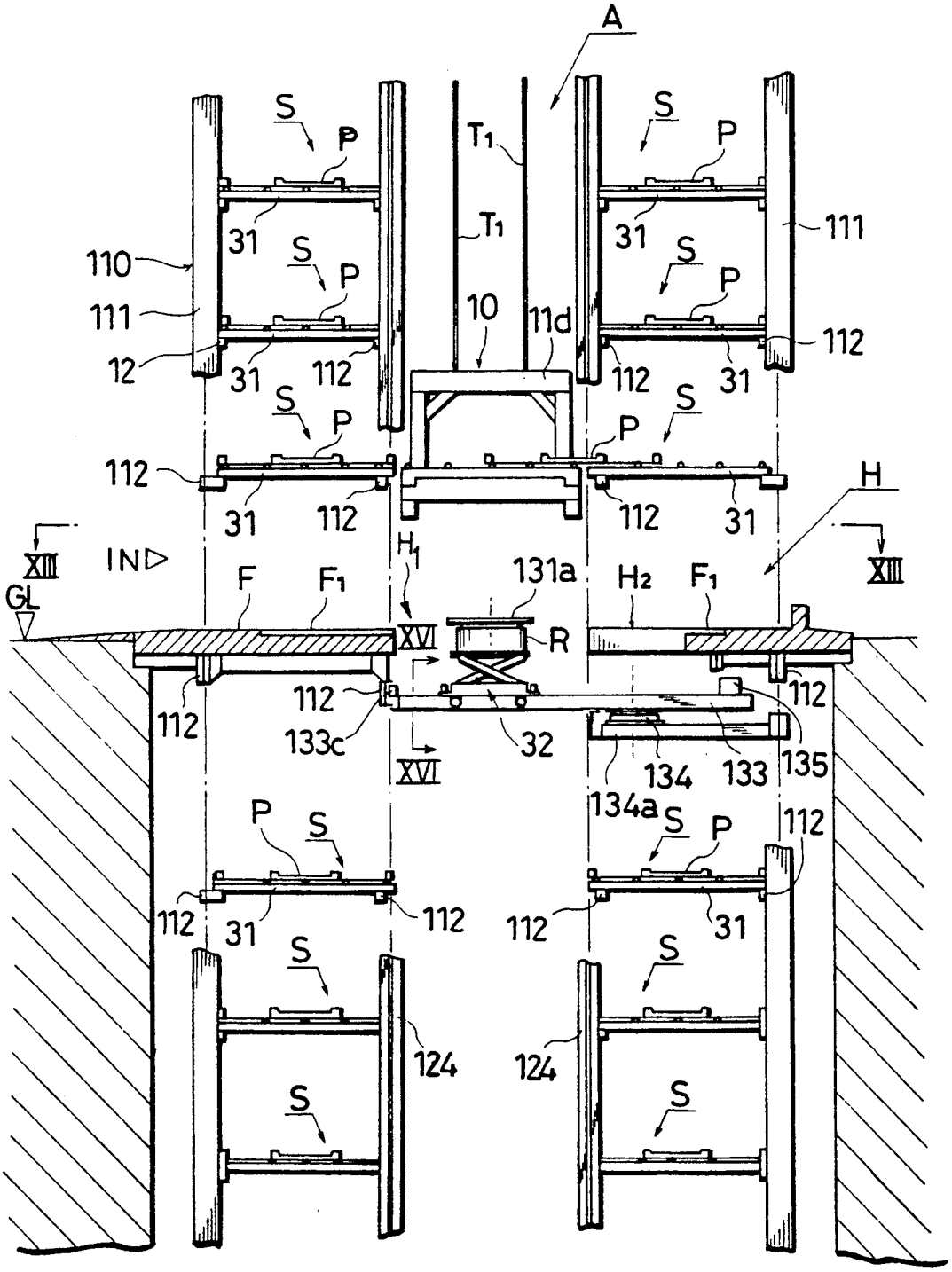
FIGS. 12 to 21 are explantory views of a home position according to the present invention.

In the cubic parking apparatus, a parking structure 110 is interiorly formed with a vertical space A through which the carriage 10 may pass of the elevator device, and a number of parking spaces S, S . . . are dispoed on opposite sides thereof in a vertical multi-stage fashion, as shown in FIG. 12.

The parking structure 100 is a tower-like structure including not only floors above the ground but floors under the ground level GL. The parking structure 110 comprises post members 111, 111 . . . at four corners and horizontal members 112, 112 . . . for connecting the post members in a frame-like configuration, and the like. The parking spaces S, S . . . are partitioned by the horizontal members 112, 112 . . . arranged in an equi-spaced relation. Guides 31 each having a roller incoporated therein are mounted on the horizontal members 112, 112 of each parking space S, and a pallet P for moving a vehicle is arranged on each guide 31. The pallets P, P . . . horizontally move toward the vertical space A.

The home position H for moving a vehicle to and from a parking space is provided on the first floor on the ground, and on the ground side of the parking structure 100, floors above the second floor are utilized as parking floors.

The home position H is provided with a floor surface F used to introduce a vehicle and on which occupants may get on and off. The floor surface F is formed in its central portion with a passage opening $H_1$ for passing the carriage 10 therethough. An area and direction of the passage opening $H_1$ are adjusted to a plane area and direction of the vertical space A and at a right angle to "IN" of the vehicle. The floor surface F on the side far from the "IN" is partly formed with an opening $H_2$ so as to spread the passage opening $H_1$. The floor surface is further provided in two locations with recesses $F_1$ and $F_1$ corresponding to the plate-thickness of the Pallet P to prevent an occurrence of difference in level from the floor surface F when the pallet P is placed toward the "IN".

In the home position H, a turning device R is provided at the lower portion of the floor surface F. The turning device R is loaded on a movable base 133 through a lifter device 132. The lifter device 132 is movable along the movable base 133. Accordingly, the turning device R rotates a turn-table 131a, is moved up and down through the lifter device 132a and can be moved horizontally along the movable base 133 through the lifter device 132.

Figure 13:
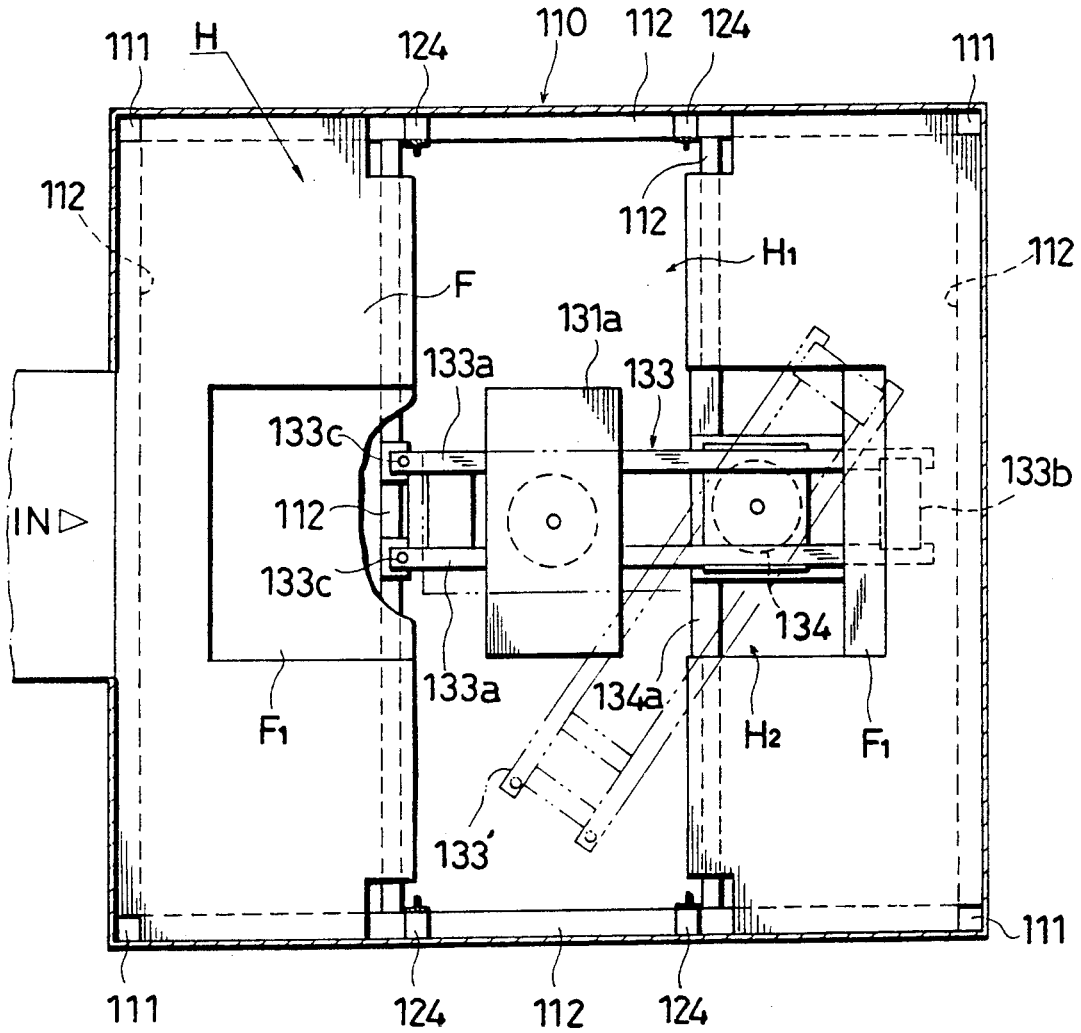

The movable base 133 is provided with a pair of beams 133a, 133a as shown in FIG. 13 and mounted turnably in a horizontal direction through a turning unit 134 arranged below the opening $H_2$. The turning unit 134 is fixedly mounted on a support member 134a.

Figure 14:
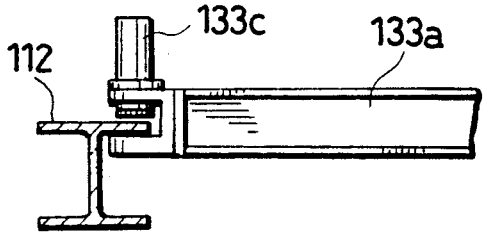

Hydraulic cylinders 133c, 133c are mounted on the extreme ends of the beams 133a, 133a as shown in FIGS. 13 and 14 so that when the hydraulic cylinders 133c, 133c are extended, the extreme ends of the beams 133a, 133a can be temporarily locked with respect to one horizontal member 112 for forming an edge of the passage opening $H_1$. The movable base 133 has its extreme end locked whereby the former is supported at two points by the turning unit 134 and the horizontal member 112 positioned on the opposite sides of the passage opening $H_1$. The turning device R and the turning unit 134 house therein an independent drive source therein.

Figure 15:
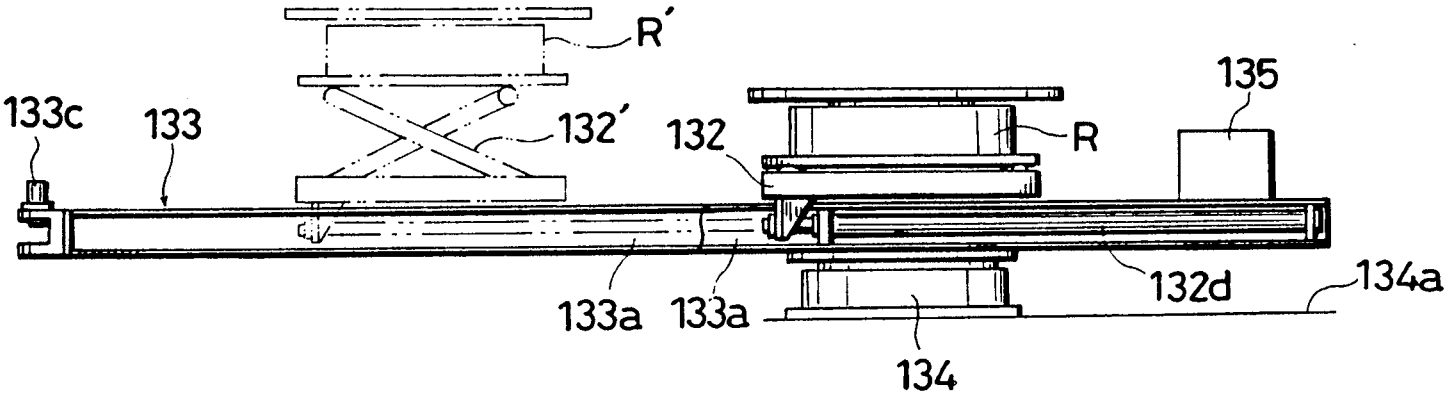
Figure 16:
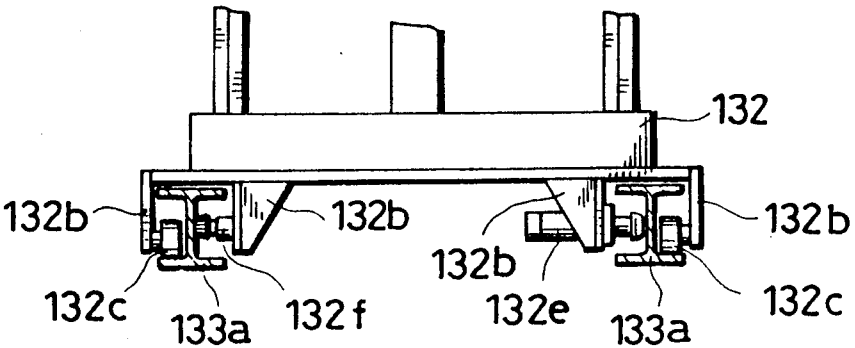
Figure 17:
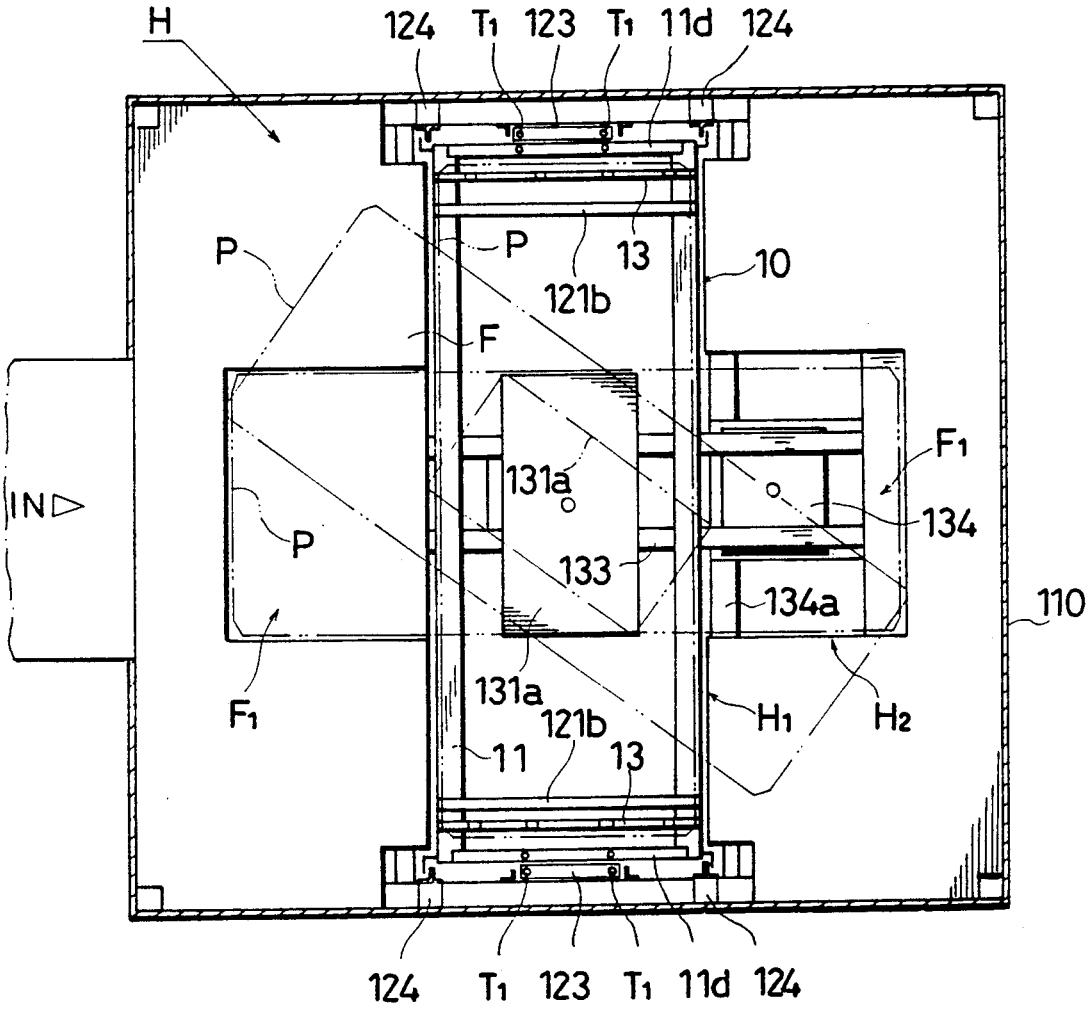

The lifter device 132 is provided with a pantograph type link mechanism which can vertically move the turning device R by a hydraulic cylinder not shown as a drive source. The lifter device 132 can travel on the beams 133a, 133a of the movable base 133 by means of travel rollers 132c, 132c mounted on external brackets 132b, 132b as shown in FIG. 16 and are driven by a hydraulic cylinder 132d (see FIG. 15) disposed along the beams 133a. A hydraulic cylinder 132e for positioning is mounted on one of internal brackets 132b, 132b as shown in FIG. 16. When the hydraulic cylinder 132e is extended, the turning device R can be stopped and temporarily locked at a suitable position on the beams 133a, 133a in cooperation with a stopper 132f mounted on the other bracket 132*b*. The hydraulic cylinder 132*d* has a stroke for delivering the turning device R loaded on the lifter device 132 from the position of the turning unit 134 to the central portion of the passage opening $H_1$. Oil pressure is supplied from a hydraulic unit 135 loaded on the rear end of the movable base 133 as shown in FIG. 15 to the hydraulic cylinders 132*d*, 132*e*.

The carriage 10 comprises a frame-like body 11 and suspended portions 11*d*, 11*d* at opposite ends in a longitudinal direction thereof (see FIG. 17), the body 11 having a central portion not closed but vertically opened. The body 11 is formed to be slightly larger than the pallet P and slightly smaller than the passage opening $H_1$ so that the former with the pallet P loaded thereon may vertically pass through the passage opening $H_1$. Closer to opposite ends of the body 11 are disposed a pair of drive conveyors 121*b*, 121*b* for horizontally moving the pallet P and a pair of lateral guides 13, 13 therealong. Each lateral guide 13 has a construction equal to that of the guide 31 in each parking space S and can slidably support the pallet P. The drive conveyor 121*b* can be horizontally moved in a bidirection by means of a moving hook member not shown.

The carriage 10 can be moved up and down while being guided by guide rails 124, 124 . . . disposed at four corners of the vertical space A and longitudinally extending through the parking structure 110 passing four corners of the passage opening $H_1$. The carriage 10 has a drive section in a machine room on the uppermost floor of the parking structure 110 and is suspended by four ropes $T_1$, $T_1$ . . . therefrom. One end of the ropes $T_1$, $T_1$ . . . is connected to counterweights 123, 123 via the drive section, and is balanced in with relative to the carriage 10 to thereby decrease the required maximum output of the drive section.

Movement of car into and out of the cubic parking apparatus as described above is carried out through the pallets P, P . . .

Figure 18:
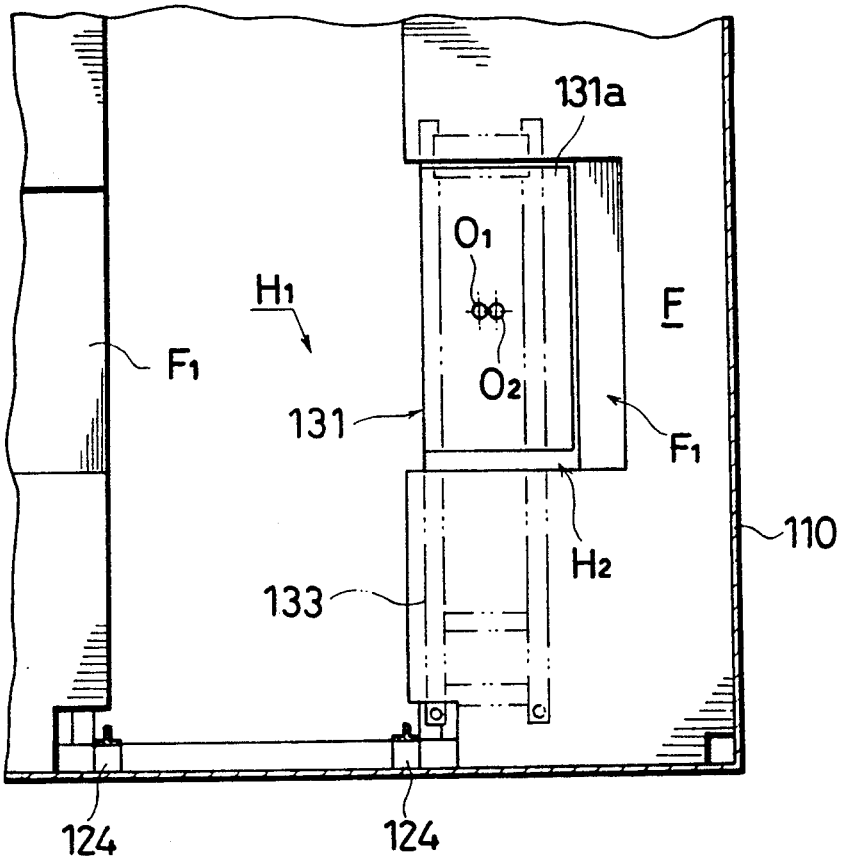

In moving the car into the parking apparatus, the carriage 10 is first moved to a position of a suitable parking space S, and the pallet P thereat is placed on the carriage 10 by the sliding operation of the transfer device and moved upwardly close to the home position H. At this time, the turning device R is retreated from the passage opening $H_1$ of the home position H as shown in FIG. 18. That is, the movable base 133 is placed in parallel with the passage opening $H_1$ by the turning unit 134, and the turning device R is received under the opening $H_2$ together with the lifter device 132 and retreats. At this time, the turntable 131*a* of the turning device R can close the approximately whole opening $H_2$, and the height thereof is made to be the approximately same height as that of the recesses $F_1$, $F_1$ of the floor surface F by contracting the lifter device 132.

Thereafter, the turning device R is arranged at a predetermined operating position (indicated by solid line in FIG. 13) within the passage opening $H_1$. That is, it is set so that the movable base 133 is horizontally turned by the turning unit 134 (indicated by dash-dotted contour lines in FIG. 2) so that the movable base 133 may cross the passage opening $H_1$, extreme ends thereof being locked by the hydraulic cylinders 133*c*, 133*c*. Then, the hydraulic cylinder 132*d* is extended to move foward the lifter device R and the turning device 131 to the central portion of the passage opening $H_1$ to lock them by the hydraulic cylinder 132*e* (see FIG. 16). When the movable base 133 is turned by the turning unit 134, the turning device R is rotated in the opposite direction whereby the relative relationship between the turntable 131*a* and the opening $H_2$ is maintained constant.

Figure 19:
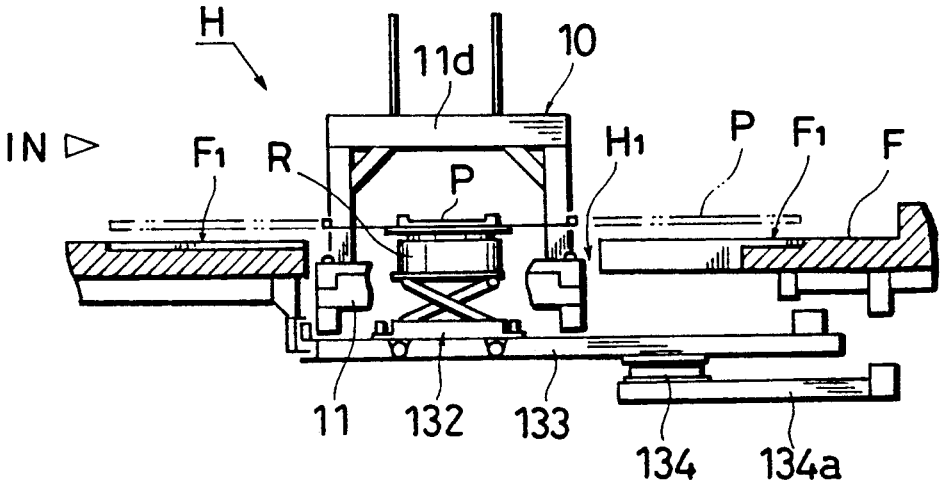

Next, as shown in FIG. 19, the carriage 10 is moved down till the body 11 assumes a position lower in level than the floor surface F, and the turning device R is moved upward through the lifter device 132 whereby the pallet P on the carriage 10 is transferred onto the turntable 131*a* of the turning device R.

The turning device R with the pallet P placed thereon is rotated through about 90° (indicated by dash-dotted contour lines) to direct the pallet P at the "IN" of the vehicle, and the pallet P is moved down so as to be fitted into the recesses $F_1$, $F_1$ of the floor surface F by the downward movement of the lifter device 132. In this state, there occurs no difference in level between the pallet P and the floor surface F, and therefore the car is driven straight on from the "IN" to smoothly ride on the pallet P. Then, after the occupants and the like have been left out of the vehicle, the car is raised from the recesses $F_1$, $F_1$ together with the pallet P by the lifter device 132, and the car is again rotated through 90° and directed parallel with the body 11 of the carriage. Then, the carriage 10 is moved upward whereby the car can be transferred from the turning device to the carriage 10.

Figure 20:
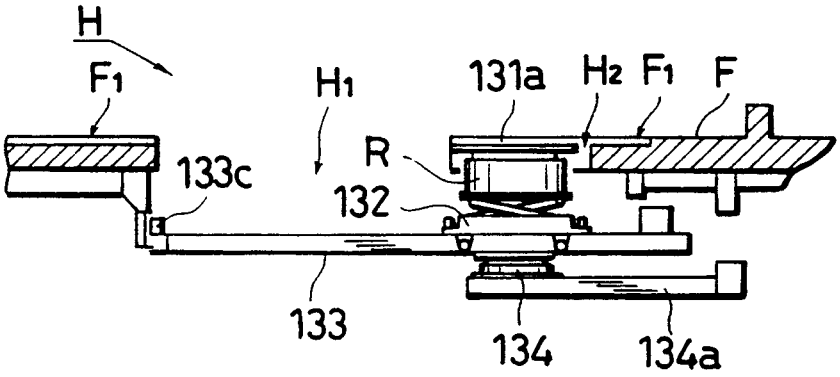

After the carriage 10 has been moved upward, the lifter device 132 is contracted and the hydraulic cylinder 132*e* is shortened to release locking of the lifter device 132, and the turning device R is retreated toward the opening $H_2$ by the hydraulic cylinder 132*d* (see FIG. 20). Then, locking of the hydraulic cylinders 133*c*, 133*c* by which the extreme end of the movable base 133 is locked is released, and the movable base 133 is returned to its original retreated position by the rotation of the turning unit 134 (FIG. 18). It is noted that at this time, the turning device R is rotatively driven in the direction opposite to the turning unit 134 in synchronism with the turning unit 134.

A turning center $O_1$ of the movable base 133 caused by the turning unit 134 is positioned so that the extreme end of the movable base 133 does not interfer with the guide rail 124 or the like. The turning center $O_1$ is not always required to register with a rotational center $O_2$ of the turning device R.

When the turning device R together with the movable base 133 is retreated from the passage opening $H_1$ as described above, the carriage 10 with the vehicle loaded thereon can vertically pass through the passage opening $H_1$. That is, even if the home position H is provided on a suitable halfway floor of the parking structure 10, vertical movement of the carriage 10 is not at all obstructed. Therefore, the home position H can be selectively provided not only on the first floor but on a suitable floor. Needless to say, the present invention is very effective in the case where the parking structure 110 includes no underground floor and the home position H is provided on a floor above the second floor.

Embodiment of another arrangement of turning device

Figure 21:
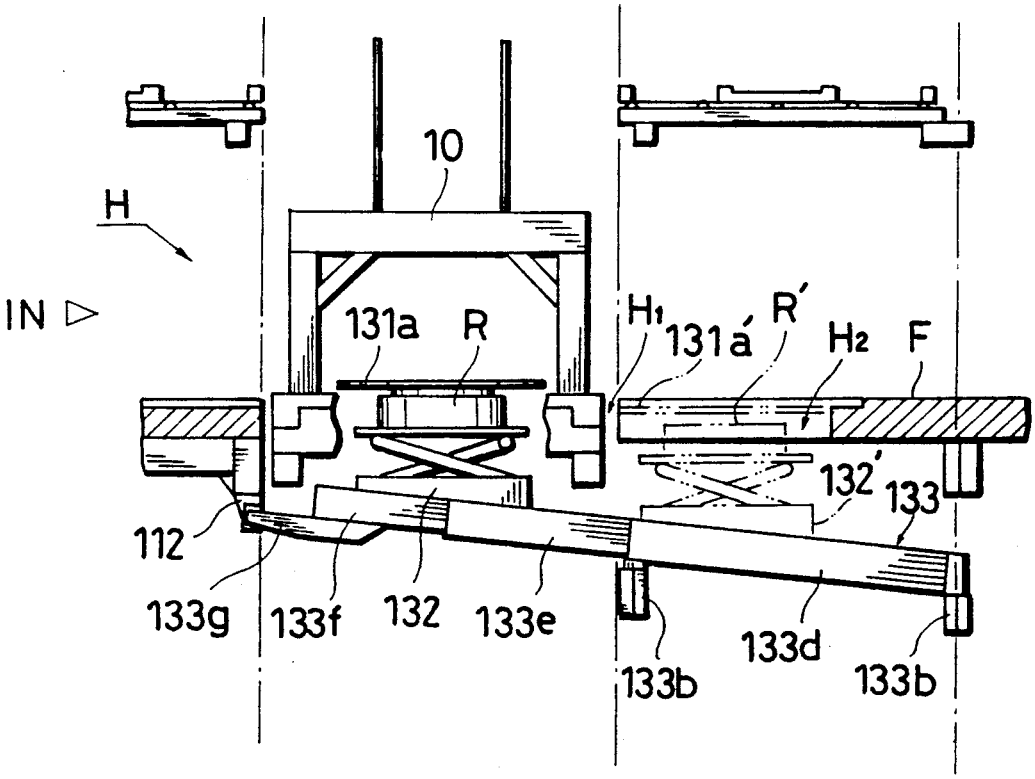

FIG. 21 is a partly sectional view showing another arrangement of the turning device R. An expansible movable base 133 comprises a fixed beam 133*d* supported by support members 133*b*, 133*b*, and slide beams 133*e*, 133*f* extended and contracted in a telescopic manner with respect to the fixed beam 133*d*, the slide beamss 133*e*, 133*f* with the turning device R and a lifter device 132 loaded thereon capable being extended and contracted so as to cross a passage opening $H_1$. The fixed beams 133*d* is disposed horizontally or with an ascending slope, and the turning device R is secured to the slide beam 133*f* through the lifter device 132. A fixed arm 133*g* is mounted on the extreme end of the slide beam 133*f*, and said extreme end is temporarily fixed with respect to a horizontal member 112 on the side opposite to the passage opening $H_1$ by the extending operation of the movable base 133.

By extending and contracting the movable base 133, the turning device R can be moved to its operating postion (indicated by the solid line in FIG. 21) and a retreated position (indicated by the dash-dotted contour lines in FIG. 21) whereby the whole construction can be simplified. By further suitably inclining the movable base 133, it is possible to cause the extension and contraction thereof to have a function of the lifter device 132. In this case, the lifter device can be omitted.

With the structure as described above, the turning device can be retreated together with the movable base and the whole passage opening can be fully opened. Therefore, the carriage can pass through the passage opening without trouble and can be moved above and below the home position. Accordingly, the home position can be provided on a suitable halfway floor, thus providing an excellent effect in that a variety of modes including an underground floor can be easily constructed.

What is claimed is:

1. A cubic parking apparatus comprising:

a vertically movable carriage disposed within a vertical passage;

an elevator device for moving said carriage up and down within said vertical passage;

a left parking space on a left side of said vertical passage;

a right parking space on a right side of said vertical passage;

a left pallet receivable within said left parking space;

a right pallet receivable within said right parking space, said left and right pallets each being adapted to receive a car thereon;

a pair of left guides located in said left parking space;

a pair of right guides located in said right parking space;

a pair of lateral guides provided on said carriage alignable with said pair of left guides and with said pair of right guides by moving said carriage up and down within said vertical passage;

a slide frame slidably provided on said carriage, said slide frame being mounted so as to be movable in a lateral direction to bridge a gap between said carriage and either of said left and right parking spaces;

a transfer device disposed on said slide frame for transferring said left pallet from said pair of lateral guides to said pair of left guides and for transferring said right pallet from said pair of lateral guides to said pair of right guides, said transfer device including at least one engaging member; and projections provided on a lower surface of each of said left and right pallets for receiving said at least one engaging member, wherein said projections are placed in a different configuration on said left pallet than on said right pallet.

2. A cubic parking apparatus according to claim 1, wherein a space portion is formed in approximately central portion of said carriage, and a turntable having a smaller area than said space portion is disposed above a turning device.

3. A cubic parking apparatus according to claim 1, wherein said at least one engaging member is driven along one of said lateral guides.

4. A cubic parking apparatus according to claim 1, wherein:

said left and right guides and said lateral guides are each formed by a channel member having an open upper portion;

a plurality of rollers are rotatably mounted on each of said channel members; and each of said plurality of rollers has a peripheral surface partially projecting from one of said channel members.

5. A cubic parking apparatus according to claim 1, wherein said pair of left guides is provided with at least one positioning member for engagement with a positioning projection provided on the lower surface of said left pallet, said positioning member being downwardly movable by a release member provided on said slide frame to allow relative sliding movement between said left pallet and said pair of left guides when said carriage is moved laterally toward said pair of left guides.

6. A cubic parking apparatus according to claim 1, wherein said slide frame is provided with locking positioning members for locking with locking projections provided on the bottom of said left and right pallets, said locking positioning members being housed in a holder through a compression spring and being capable of moving up and down within said holder through the pivotal movement of an arm.

7. A cubic parking apparatus according to claim 1, wherein said slide frame is placed on rollers or pinions disposed on said carriage, a rack is mounted on said slide frame, and a drive device with a pinion meshed with said rack to laterally move said slide frame leftward or rightward is provided on said carriage.

8. A cubic parking apparatus according to claim 1, wherein said projections include first and second projections provided on the lower surface of each of said left and right pallets, each of said left and right pallets having a first orientation wherein said first projection aligns with said at least one engaging member, and each of said pallets having a second orientation wherein said second projection aligns with said at least one engaging member and said first projection does not align with said at least one engaging member.

9. A cubic parking apparatus according to claim 1, wherein said projections comprise first, second, third, and fourth projections, and wherein said at least one engaging member comprises first and second engaging members, such that, in a first orientation of said pallet, said first engaging member engages said first projection and said second engaging member engages said second projection, and wherein when said pallet is rotated by 180° from said first orientation of said pallet, said first engaging member engages said third projection, said second engaging member engages said fourth projection, and said first and second projections are not engaged with either of said first and second engaging members.

* * * * *